US008047582B1

(12) United States Patent
Rodgers et al.

(10) Patent No.: US 8,047,582 B1
(45) Date of Patent: Nov. 1, 2011

(54) ELECTRO-MECHANICAL LOCK

(75) Inventors: Paul Justus Rodgers, Sparks, NV (US); Larry Gene Corwin, Jr., Sparks, NV (US); Robert Hunt, Sparks, NV (US); Shawn Rubendall, Sparks, NV (US)

(73) Assignee: Securitron Magnalock Corporation, Phoenix, AZ (US)

( * ) Notice: Subject to any disclaimer, the term of this patent is extended or adjusted under 35 U.S.C. 154(b) by 983 days.

(21) Appl. No.: 12/002,994

(22) Filed: Dec. 19, 2007

Related U.S. Application Data

(60) Provisional application No. 60/876,975, filed on Dec. 23, 2006.

(51) Int. Cl.
*E05C 3/06* (2006.01)
*E05B 15/02* (2006.01)

(52) U.S. Cl. ..... 292/201; 292/340; 292/341.15

(58) Field of Classification Search ..... 292/201, 292/340, 341.15
See application file for complete search history.

(56) References Cited

U.S. PATENT DOCUMENTS 2,074,759 A * 3/1937 Richards ..... 292/68
2,957,721 A * 10/1960 Sklaw et al. ..... 292/341.15
3,142,166 A * 7/1964 Folger et al. ..... 70/282
3,157,042 A * 11/1964 Wolz ..... 70/279.1
3,888,527 A * 6/1975 Haisler ..... 292/213
3,955,840 A * 5/1976 Rawls et al. ..... 292/229
4,613,176 A * 9/1986 Kelly ..... 292/201
4,685,709 A * 8/1987 Kambic ..... 292/201
4,978,153 A * 12/1990 Hirsch et al. ..... 292/201
5,226,684 A * 7/1993 De La Garza ..... 292/213
5,230,179 A 7/1993 Richmond et al.
5,492,382 A 2/1996 McBride et al.
5,690,373 A * 11/1997 Luker ..... 292/201
6,027,148 A * 2/2000 Shoemaker ..... 292/216
6,139,073 A * 10/2000 Heffner et al. ..... 292/201
6,192,723 B1 2/2001 Brownell, Sr.
6,629,713 B1 10/2003 Duffy et al.
6,681,607 B2 1/2004 Geringer
7,296,830 B2 * 11/2007 Koveal et al. ..... 292/201
7,416,228 B2 * 8/2008 Pfitzinger et al. ..... 292/216
7,614,669 B2 * 11/2009 Geringer et al. ..... 292/144
7,726,707 B2 * 6/2010 Simchayoff et al. ..... 292/216
7,780,208 B2 * 8/2010 Koppenhoehl et al. ..... 292/340

* cited by examiner

*Primary Examiner* — Carlos Lugo
(74) *Attorney, Agent, or Firm* — Woods Oviatt Gilman LLP

(57) ABSTRACT

An electro-mechanical lock for gates and similar applications having a latch assembly and a strike assembly. The strike assembly has a strike which is self-adjusting to accommodate misalignment to guide the strike roller into proper engagement in the latch assembly. The latch assembly has a latch which is operably connected to a solenoid by a trigger and transfer mechanism which provides pre-load capability.

21 Claims, 14 Drawing Sheets

Swinging Gate Mount

ELECTRO-MECHANICAL LOCK

CROSS REFERENCE IS MADE TO RELATED APPLICATION

This application is based on U.S. Provisional Patent Application Ser. No. 60/876,975, filed Dec. 23, 2006, of the same title.

FIELD OF THE INVENTION

The present invention relates to an electro-mechanical lock particularly suited for use in applications such as with gates to control access and egress.

BACKGROUND OF THE INVENTION

Areas such as industrial yards, apartment complexes, office complexes often control entry and egress. This is accomplished by use of a security gate which may either be a sliding gate or a pivotal gate and requires the use of a key, entry of code or use of a magnetic card to actuate an electro-mechanical lock to open the gate.

A problem that arises with gates of this type is that they are generally quite large and often heavy and, over time due to normal use, wear and tear and in some cases abuse, the latch and strike components of the electro-mechanical lock become misaligned. This misalignment may cause the lock components to not properly engage, resulting in lack of security requiring maintenance and repair.

Electromagnetic locks are commonly used to address these applications, but only in fail safe or locked when power is applied mode. This mode of locking is beneficial to accommodate the pre-load often found with a heavy or misaligned gate. Currently there are no solutions for fail secure applications where constant power is not available or not preferred. Another problem with conventional electro-mechanical or electro-magnetic locking products used with various access control devices is in matching the voltage of the electric locking product with the access control components. Yet another problem is the alignment of electromechanical locks with the movable gate mounted strike device.

BRIEF SUMMARY OF THE INVENTION

Briefly, the present invention relates to an electro-mechanical security lock for exterior or interior use. The electro-mechanical lock has a strong mounting chassis, an access protection cover and a strike assembly that accommodates misalignment due to gate sag and tracking error of up to ½ inch both horizontally and vertically. The lock may be used for both swinging and sliding gate applications. Additionally, the electro-mechanical lock has a release mechanism that allows the lock to open under a range of preload forces up to 100 pounds. The lock can be configured in either a fail secure or a fail safe mode in the field. The lock has an auto sensing voltage circuit which functions with input voltage for 10.8 to 28.8 volts. The lock has a key override component to provide manual locking and/or unlocking without power.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 2:
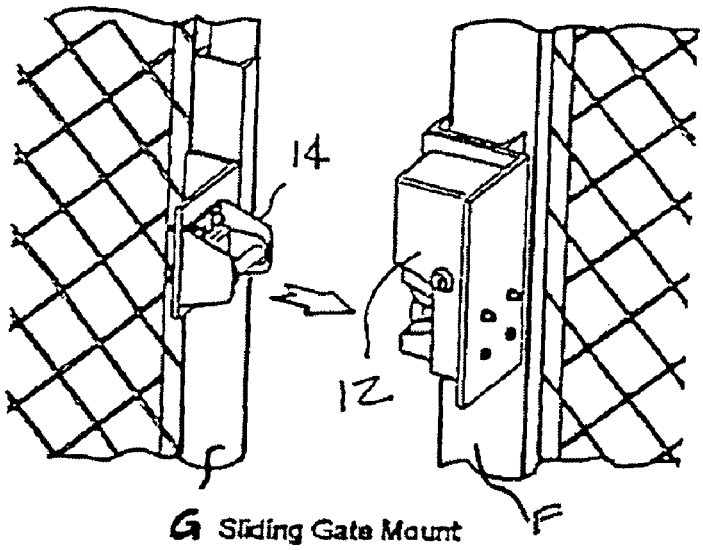
FIG. 2 is a perspective view showing the electro-mechanical lock of the present invention mounted in a sliding gate installation.
Figure 1:
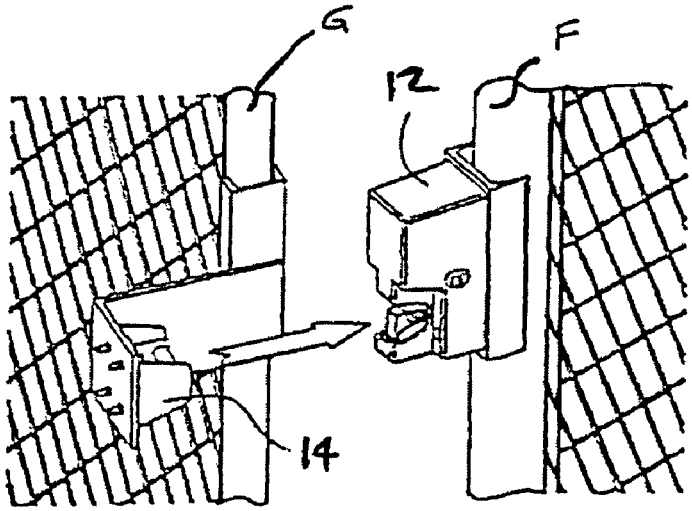
FIG. 1 is a perspective view showing the lock of the present invention mounted on a swinging gate installation.

The gate lock 10 of the present invention has a latch assembly 12 and a strike assembly 14. As seen in FIGS. 1 and 2, the strike assembly 14 mounts on an edge of a closure such as on a frame section of a swinging gate G shown in FIG. 1 or on a sliding gate G as shown in FIG. 2. The mating component, the latch assembly 12, is mounted on an adjacent gate frame section F which may be either a swinging gate frame or a fixed post of a sliding gate. In the locked position, the strike assembly 14 is engaged in the latch assembly 12, as will be explained.

The strike assembly 14 is best shown in FIGS. 4, 5, 5A and 5B is the captured component in the gate lock assembly. The strike assembly has a base shield 16 with a backplate 18 having spaced-apart, forwardly extending flanges 20. The strike backplate 18 is secured to a gate frame F component by suitable fasteners extending through mounting holes 22. A strike swivel clevis 24 has a baseplate 26 and forwardly extending arms 28 and is generally U-shaped and is dimensioned to be received within base shield 16 between the flanges 20 attached to the back plate 18 at the strike base shield 16. The opposite arms of the swivel clevis 24 each define a bore 30 near their outer ends and each receives a pivot or axle shown as a rivet 32. The rivets 32 are press fit into the bores 30 in the swivel clevis and are received within the bore 35 of cylindrical strike sleeve 34. The diameters of the rivets 32 are less than the interior diameter of the bore 35 in the strike sleeve such that the strike sleeve 34 is free to rotate supported on the rivets. In order to provide freedom of rotation, a small axial clearance is provided between the ends of the rotatable strike sleeve 34 and the interior surfaces of the clevis arms 28.

A cover plate 40 has a generally U-shaped center section 42 and oppositely extending flanges 44. The U-shaped center section 42 has a recess 46 defined by opposite edges 45 and receives the baseplate 26 of the swivel clevis 24. The cover plate 40 is held in place by suitable fasteners 48 which, for security, extend from the rear of the strike backplate 18 of the strike base shield 16 forwardly into threaded bores 43 in the flanges 44 of the strike cover. In this way, removal or tampering with the strike cover is made more difficult.

Figure 5B:
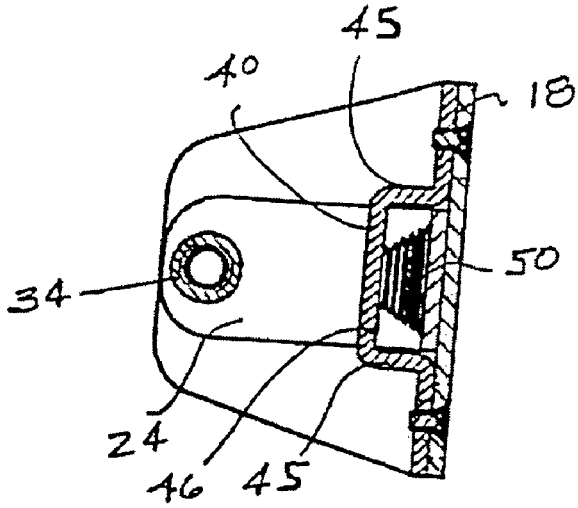
FIG. 5B is a cross-sectional view of the strike assembly in a centered position.

The recess 42 in the cover plate 40 provides clearance to allow a compression spring 50 to be interposed between the baseplate 26 of the strike swivel clevis and the cover plate 40, as best seen in FIG. 5B. This clearance allows the strike swivel clevis a range of motion as shown in FIG. 5A. The range of motion is limited by interference or engagement of the clevis 24 with the opposite horizontal edges 45 of the cover plate 40.

The forwardly extending flanges 20 block access to the rivets 32 supporting the sleeve and, accordingly, prevent tampering with these components. The flanges also restrict excessive horizontal movement of the clevis strike sleeve 34. The clearance between the swivel clevis 24 and the cover 40 allows limited rotation of the sleeve 34 about an axis perpendicular to the rear of the base as shown in FIG. 5A.

Figure 5:
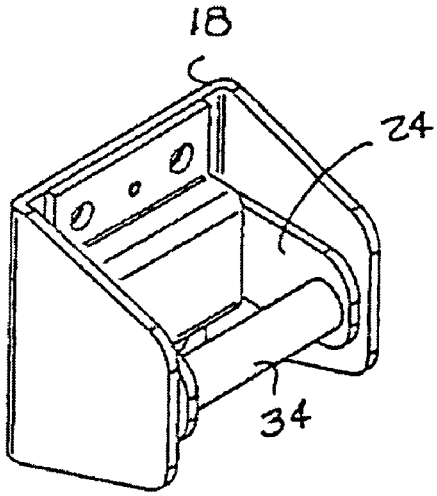
FIGS. 5 and 5A show the strike assembly in a centered and in a displaced position showing the range of motion of the strike to accommodate misalignment.
Figure 5A:
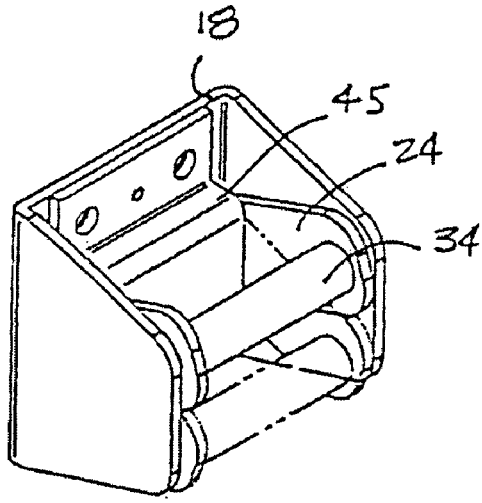

Spring 50 biases the swivel clevis 24 rearwardly into a normally self-centered position when disengaged from the latch assembly, as seen in FIG. 5. The clearance between the cover 40 and the swivel clevis 24 also compensates for a small amount of spring-back or slack in the driving mechanism of the gate or door-closing device which may be caused by a motor-driven chain or gear drive. This clearance lowers the preload on the latching system and makes opening easier.

Figure 11:
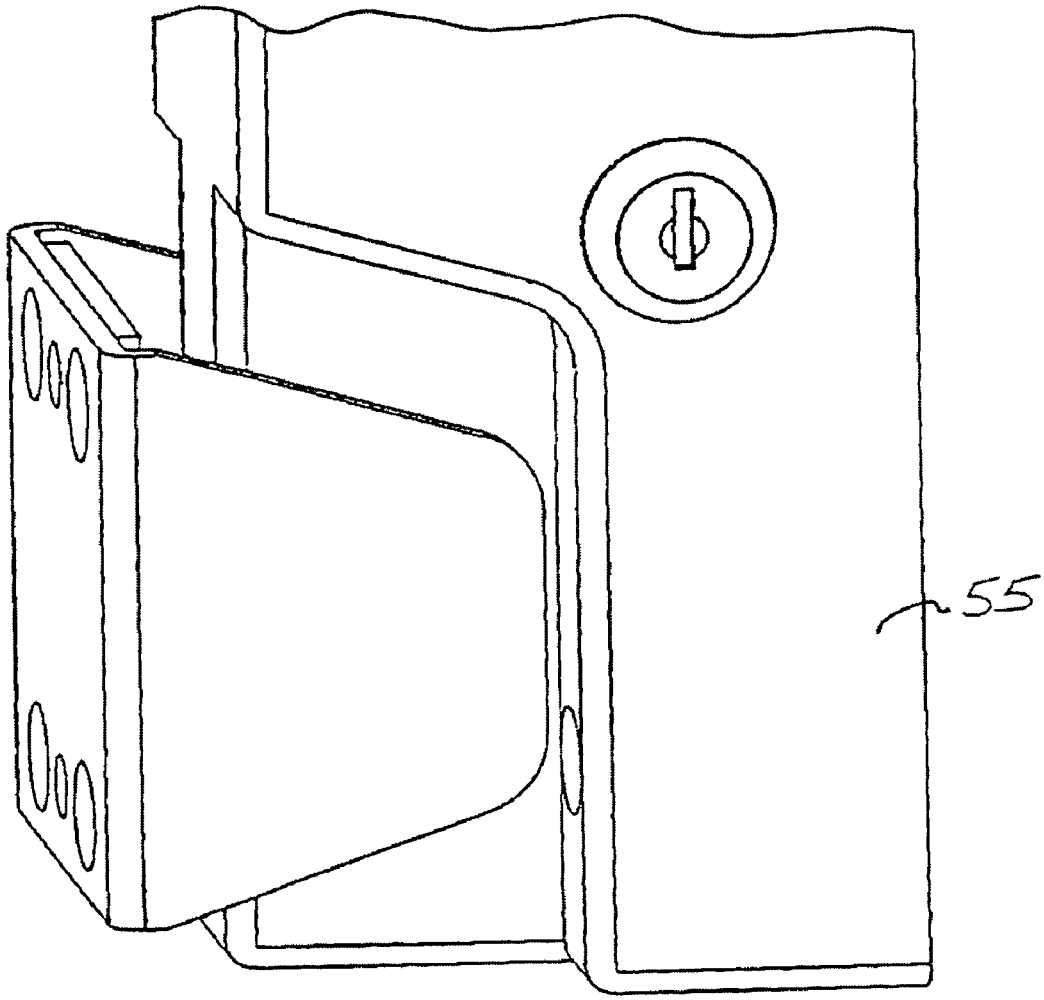
FIG. 11 is a partial view showing the latch and strike engaged.
Figure 11A:
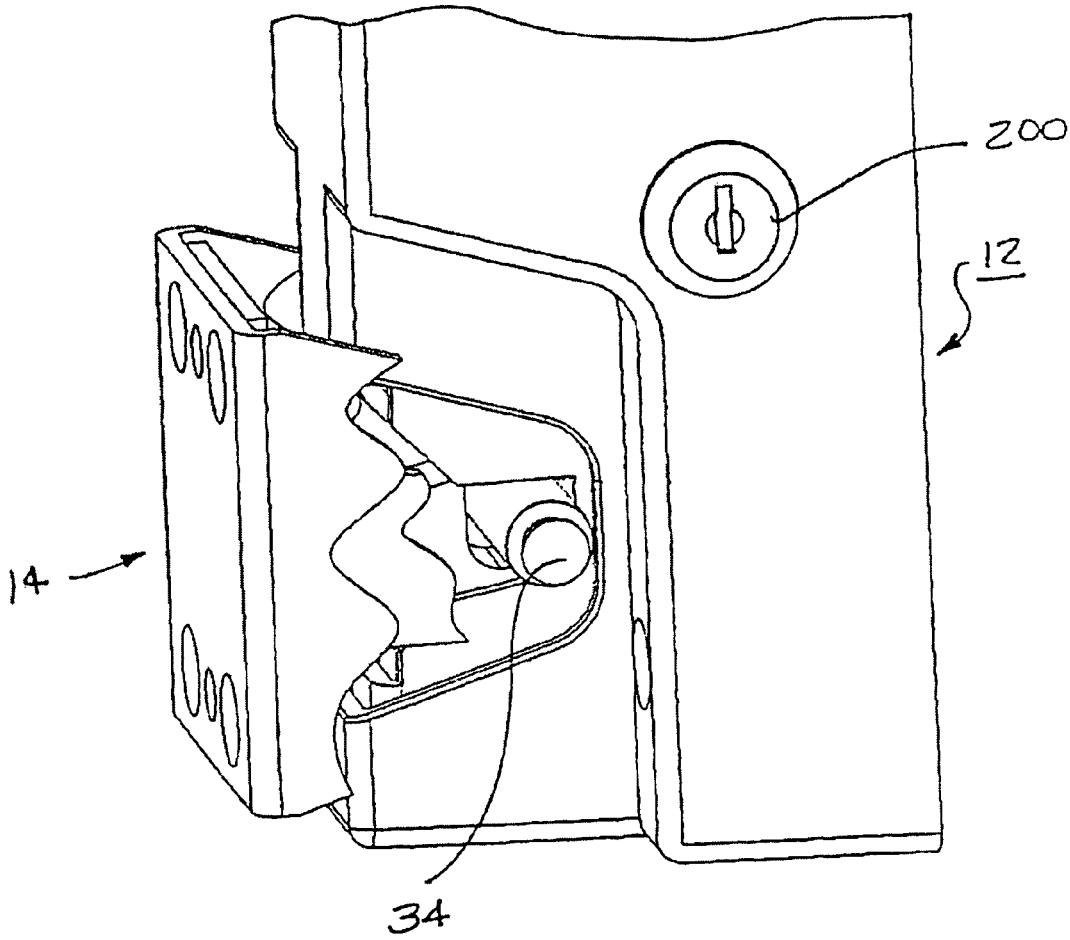
FIG. 11A is a view similar to FIG. 11 partly broken away to better illustrate the engagement of the latch and strike.

The self-aligning strike provides allowance for misalignment so that as the gate is closed bringing the strike sleeve 34 into engagement with the latch assembly 12, misalignment is accommodated. The rotatable strike sleeve 34 may be guided upwardly or downwardly, as required, by the access opening into the latch assembly to properly seat in the locking position. The accommodated vertical motion is in the range of approximately plus or minus ½ inch vertically from the center line of the lock to the center line of the strike. This is illustrated in FIG. 5A. Horizontal misalignment of the strike and latch is also accommodated as will be explained below. FIGS. 11 and 11A illustrate the engagement of the strike and latch assemblies.

Figure 3:
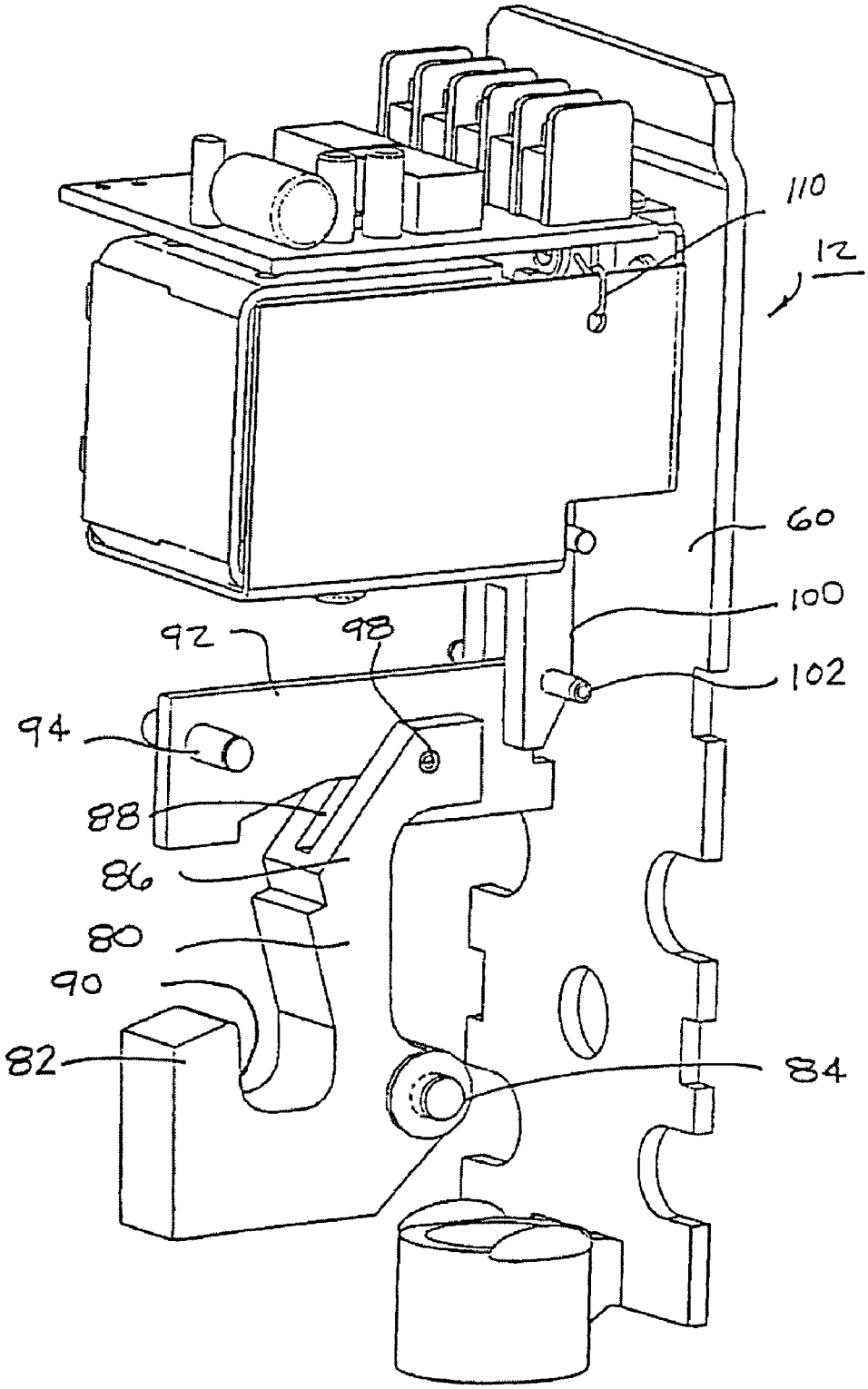
FIG. 3 is a perspective view of the electro-mechanical latch component of the lock assembly of the present invention with the cover removed.
Figure 4:
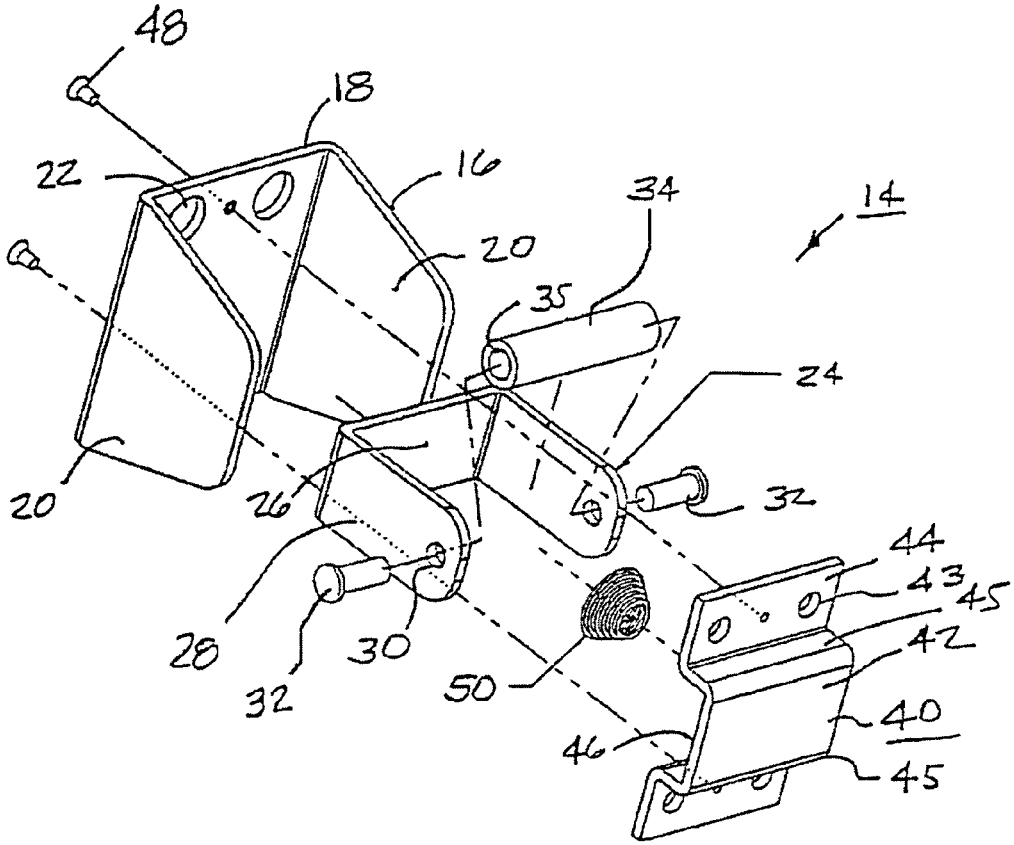
FIG. 4 is an exploded view of the strike assembly.
Figure 6:
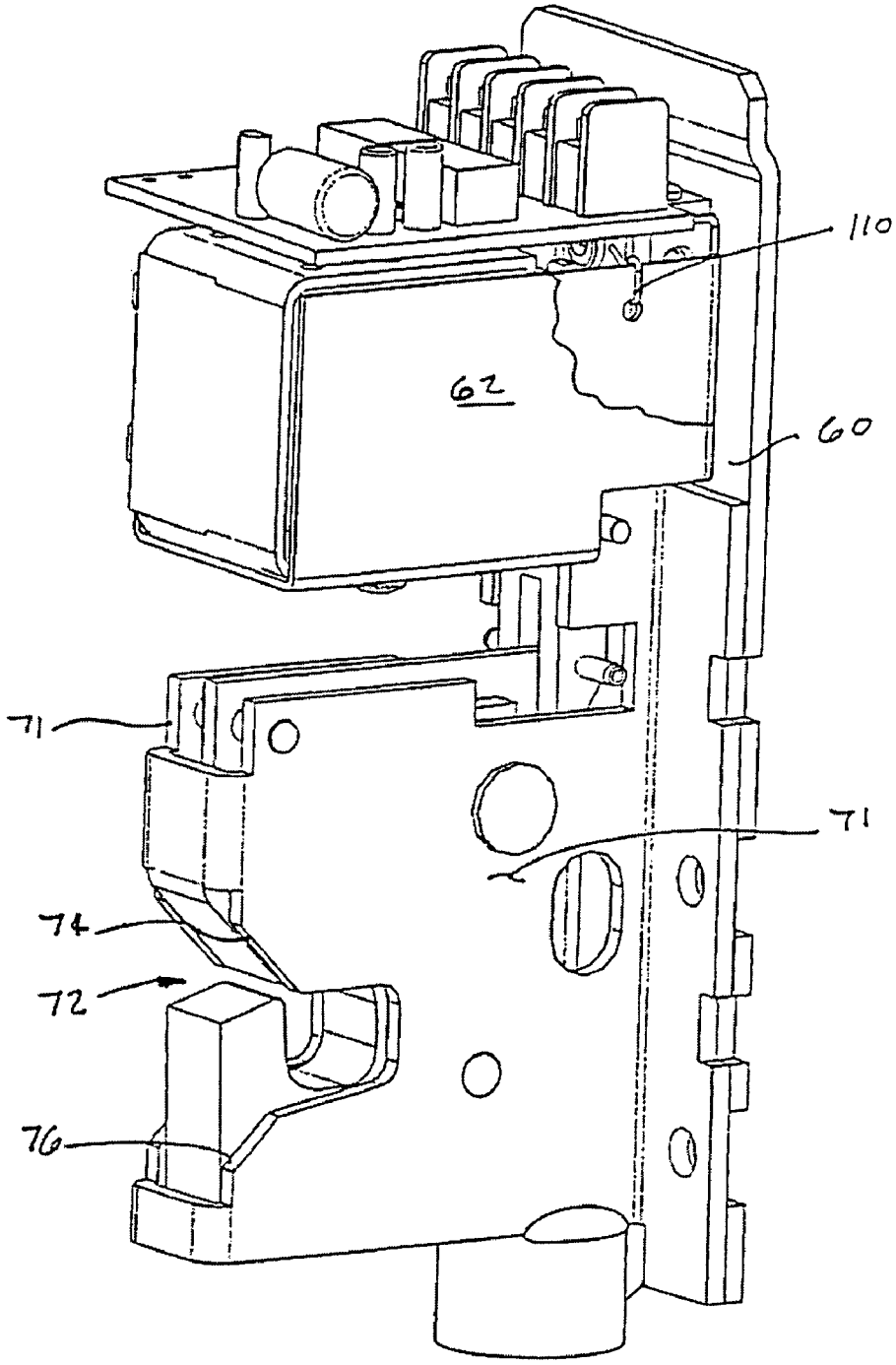
FIG. 6 is a perspective view with the cover removed which shows the latch in a locked position.
Figure 7:
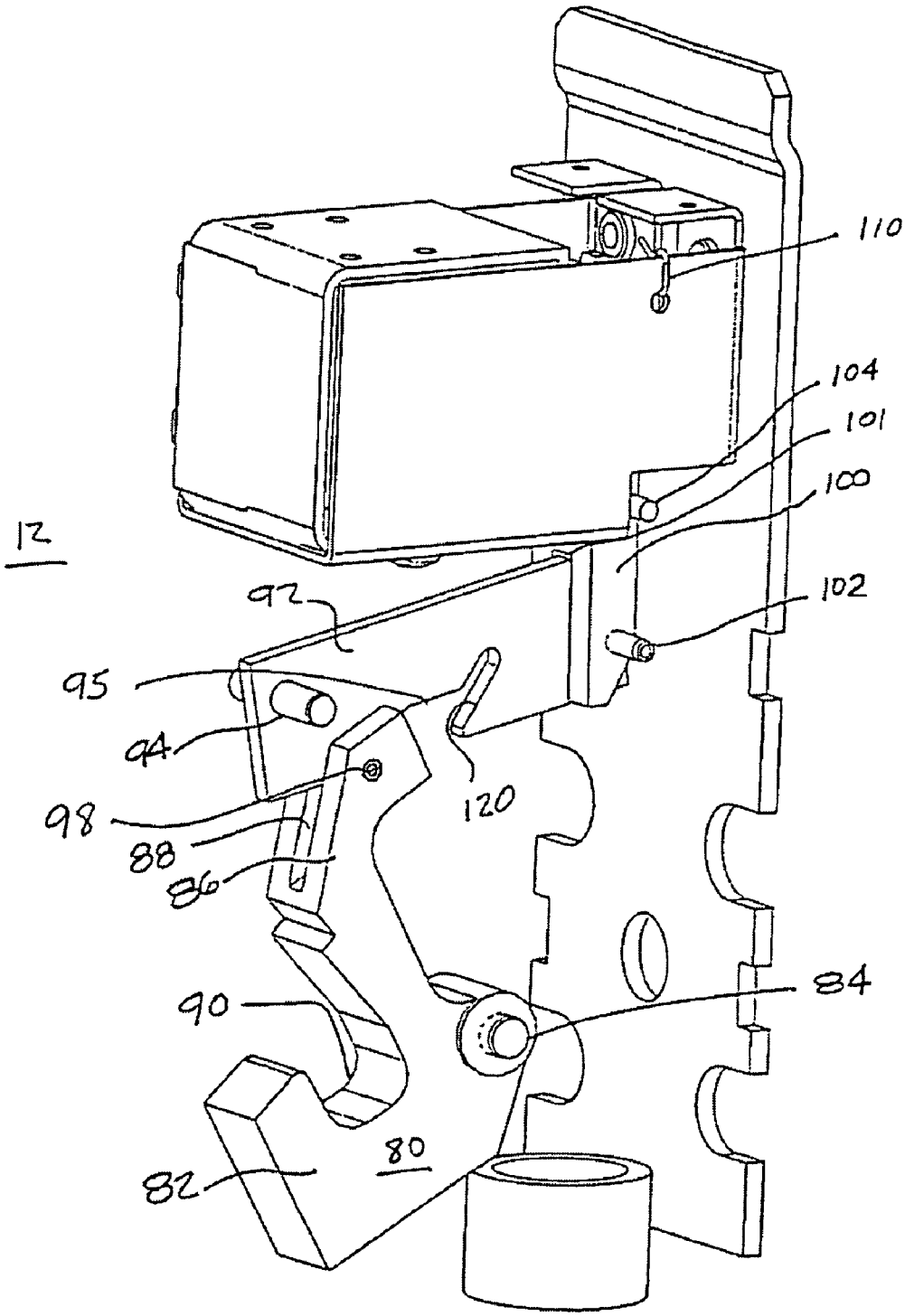
FIG. 7 is a view similar to FIG. 6 showing the latch in an open position.

The corresponding latch assembly 12 is shown in FIGS. 3, 6 and 7 and includes a chassis 60 which mounts to a component such as the frame F of the gate, as described above. An electrically-operated solenoid 62 carries a plunger 64 which, at its outer end, is longitudinally split at 66 and carries a pin 68 which extends transversely through the split outer end in the mode shown in FIG. 8.

The lower portion of the lock chassis 60 has a housing which has opposite sidewalls 71 each of which have a forwardly extending opening 72 with angular, outwardly diverging sidewalls 74, 76 which serve to guide the strike sleeve 34 into proper engagement, providing a large "target" for engagement of the latch and strike. The angled openings 72, in cooperation with the rotatable swivel clevis 24, permit the strike assembly 14 and latch assembly 12 to engage as seen in FIG. 11A. Further, the width of the strike sleeve 34 is wider than the keeper 82 to accommodate horizontal misalignment of the latch and strike assemblies.

Latch 80 has a keeper 82 at its forward end and is pivotally mounted between sidewalls 71 at pivot 84. The keeper 82 projects upwardly and seat 90 is located rearwardly the keeper to receive the strike sleeve 34. The latch 80 has an arm 86 which defines a slot 88 at its upper end. Cam follower pin 98 extends transversely across slot 88. A mating trigger 92 extends generally horizontally being pivotally connected to the housing at pivot 94 and having a cam surface 95 residing in slot 88 of the arm 86. The cam surface 95 extends rearwardly to angled trigger slot 120. The rear of the trigger 92 is slotted at 101 and engages a generally vertically extending transfer bar 100 at locking pin 102. The transfer bar is pivotal with respect to the chassis at pivot 104. The upper end of the transfer bar extends through the split end 66 of the solenoid plunger 64 but is not connected to it.

As mentioned above, the solenoid 62 is electrically actuated generally by a remote switch or other access-controlling device. In the fail secure mode shown in FIGS. 8 and 13A, the solenoid when actuated will move the plunger 64 and locking pin 102 pivoting the transfer bar 100 to a position in which it no longer blocks the trigger 92. The opening load on the gate will rotate the latch and transmit a force along the vector 3 indicated on FIG. 8. For example, if the opening load is 100 lbs, the force vector 3 will be approximately 13 lbs. Trigger 92 is forced in an opening direction, as indicated by the arrow, however, movement is blocked until the solenoid moves the blocking pin 102 which will allow the trigger to rotate upwardly. The latch 80 is then allowed to rotate forwardly and drop to a position so that the keeper 82 is no longer blocking movement of the strike outwardly.

Figure 13:
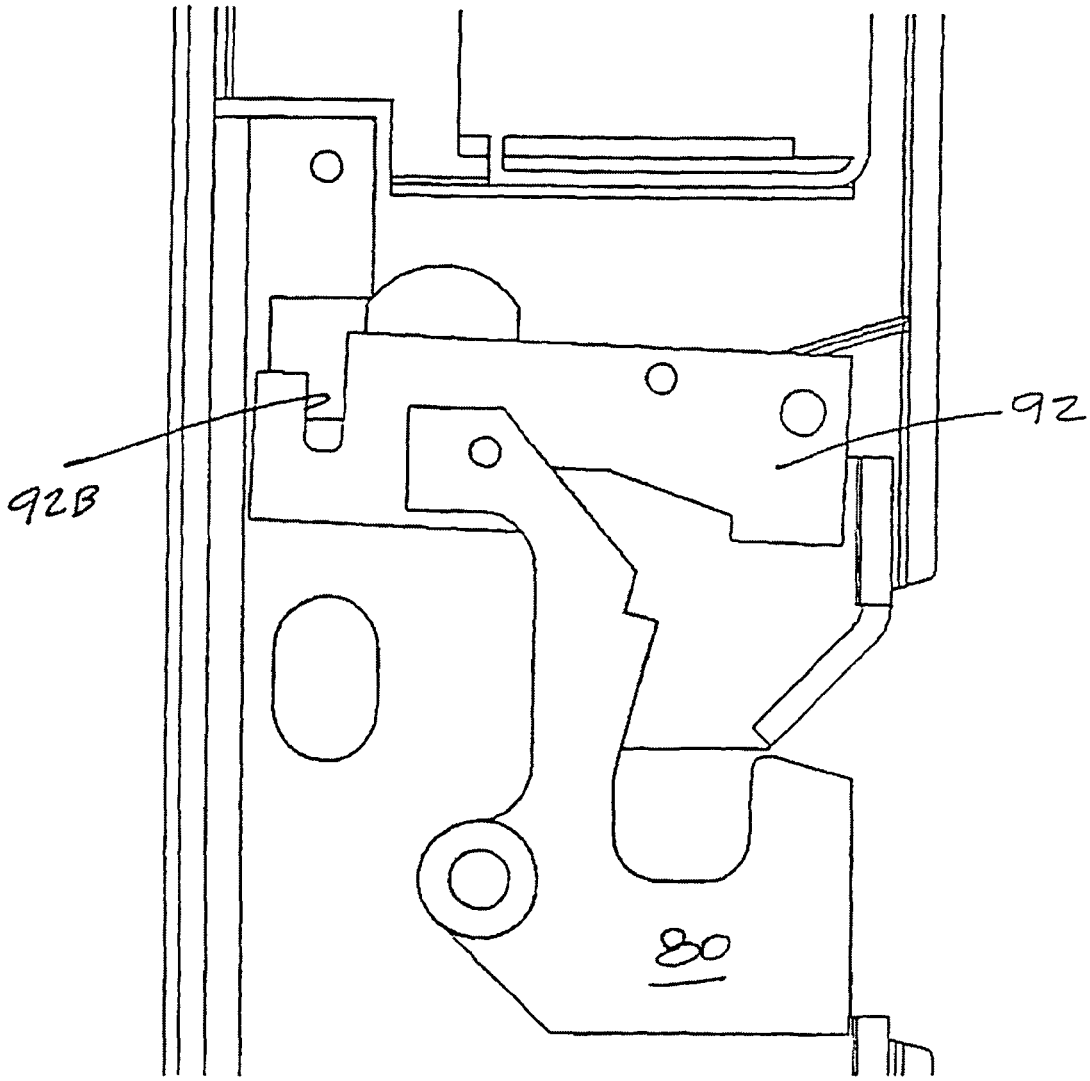
FIGS. 13 and 13A show the triggers for fail safe and fail secure operational modes.
Figure 13A:
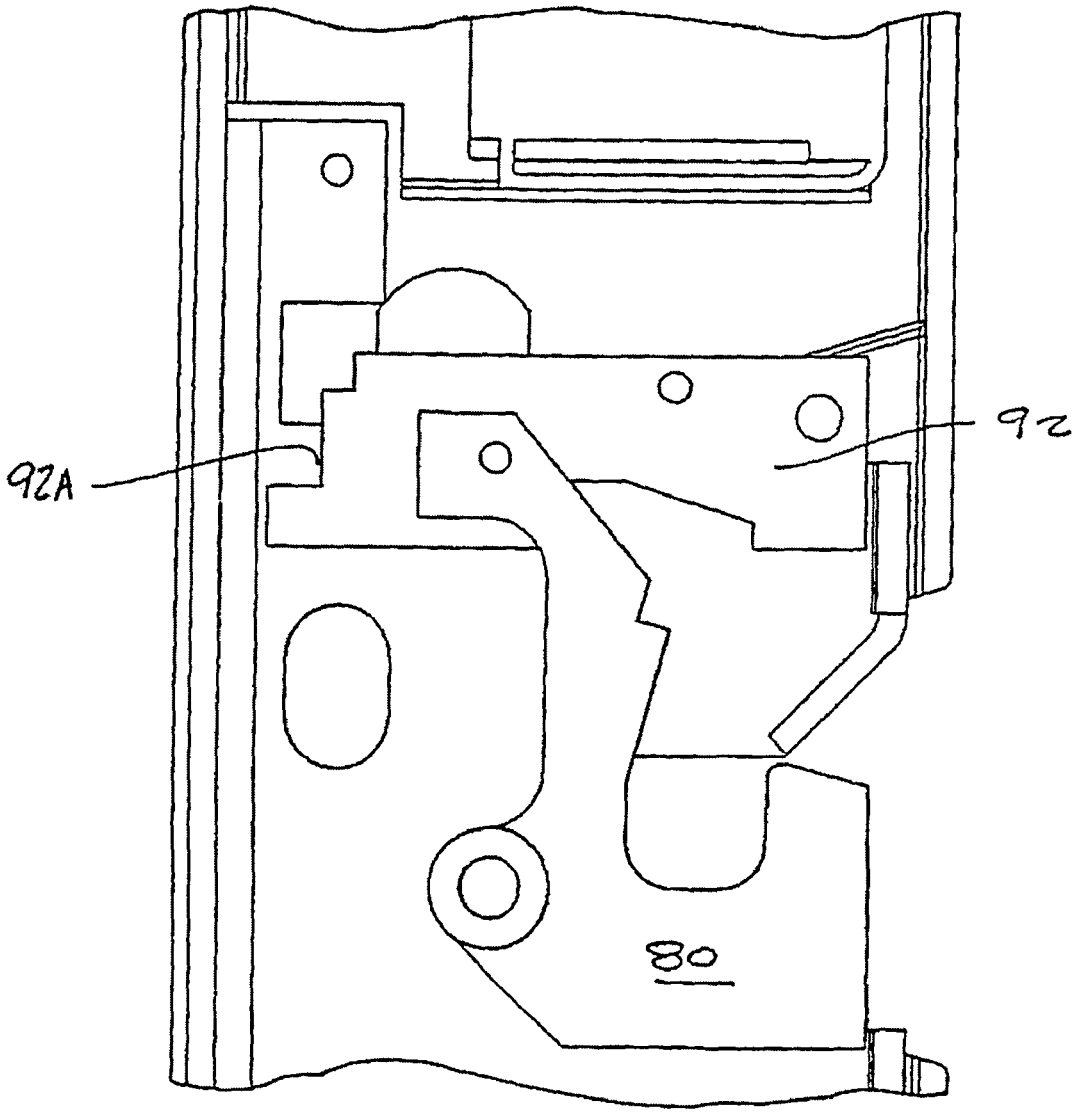

The relationship between the transfer bar, trigger and latch allow the latch to be changed from fail secure to fail safe by changing the position of the pin 102 relative to the bar 100 so that the pin 102 either blocks motion of the trigger 92 or allows motion of the trigger 92. The appropriate installation is established and the proper electrical connections are made. In the fail secure mode, the de-energized solenoid blocks the trigger 92 and current is applied to the solenoid 62 to unblock the trigger. In the fail safe mode, the trigger 92 is unblocked and the solenoid 62 energized to block the trigger. The trigger 92 is configured differently for fail safe or fail secure modes. The fail secure trigger as seen in FIG. 13A has a series of steps 92A on its rear surface whereas the fail safe trigger of FIG. 13 defines a vertical slot 92B spaced inwardly of its rear surface. The operational mode can be easily accomplished or changed in a field operation by switching from the fail safe trigger shown in FIG. 13 to the fail secure trigger shown in FIG. 13A, or vice versa.

For fail safe operation, the solenoid must be in an energize state in order for relocking to occur. No external force is required other than the engagement of the strike sleeve 34 in the latch 80 with sufficient force to move the latch rearwardly. The angled cam slot 120 in the trigger 95 is engaged by the pin 98 in the latch and the rearward motion of the latch 80 draws the trigger 92 into the locked position. The solenoid plunger 64 and the transfer bar 100 automatically re-engage with the blocking surface of the trigger 92 when the latch 80 is moved to a locked position.

The latch is reset by return of the strike sleeve 34 against the latch 80. The sleeve is guided into the seat 90 causing the latch to rotate to the locked position seen in 6. Note that the configuration of the latch surfaces is selected to align with the latch guide surface 74, 76 when the latch 80 is open.

Figure 9:
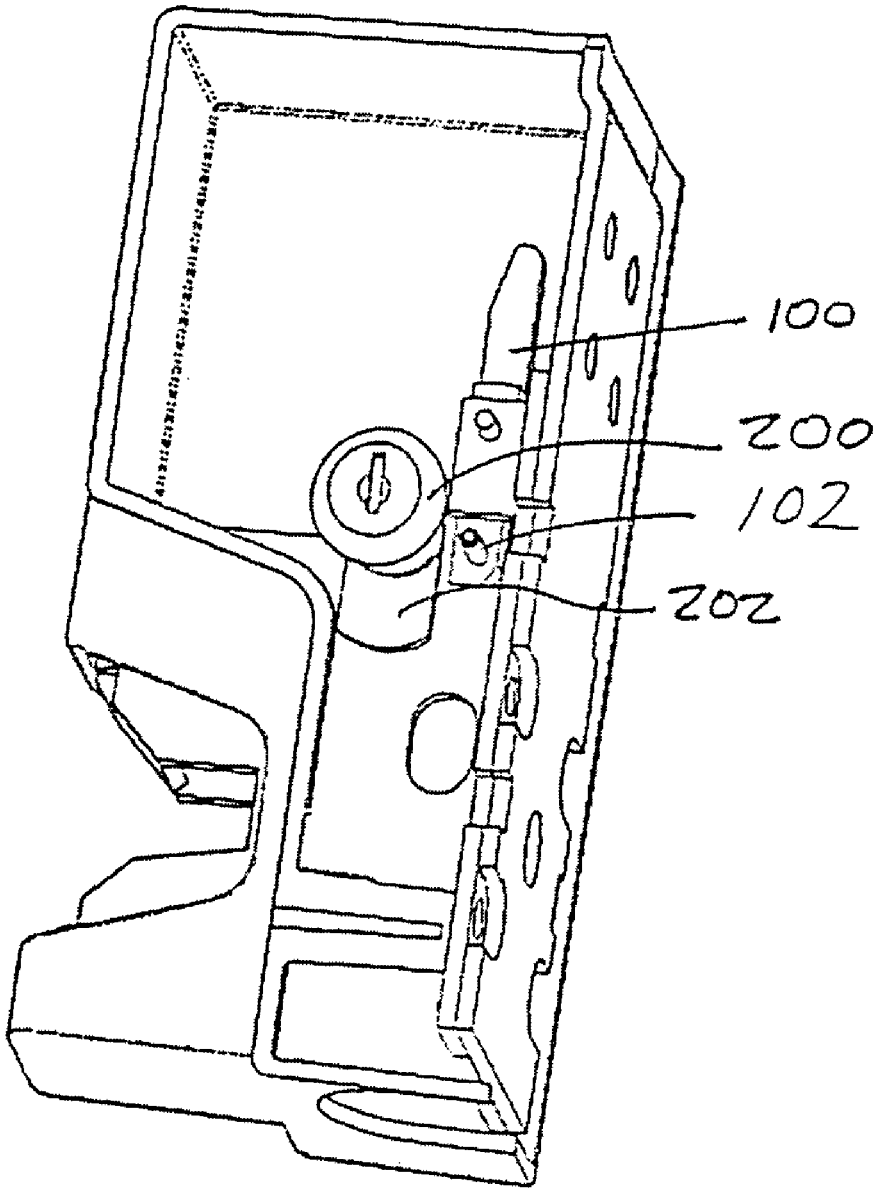
FIG. 9 is a side view of the latch partly broken away to better illustrate the manual override feature.
Figure 10:
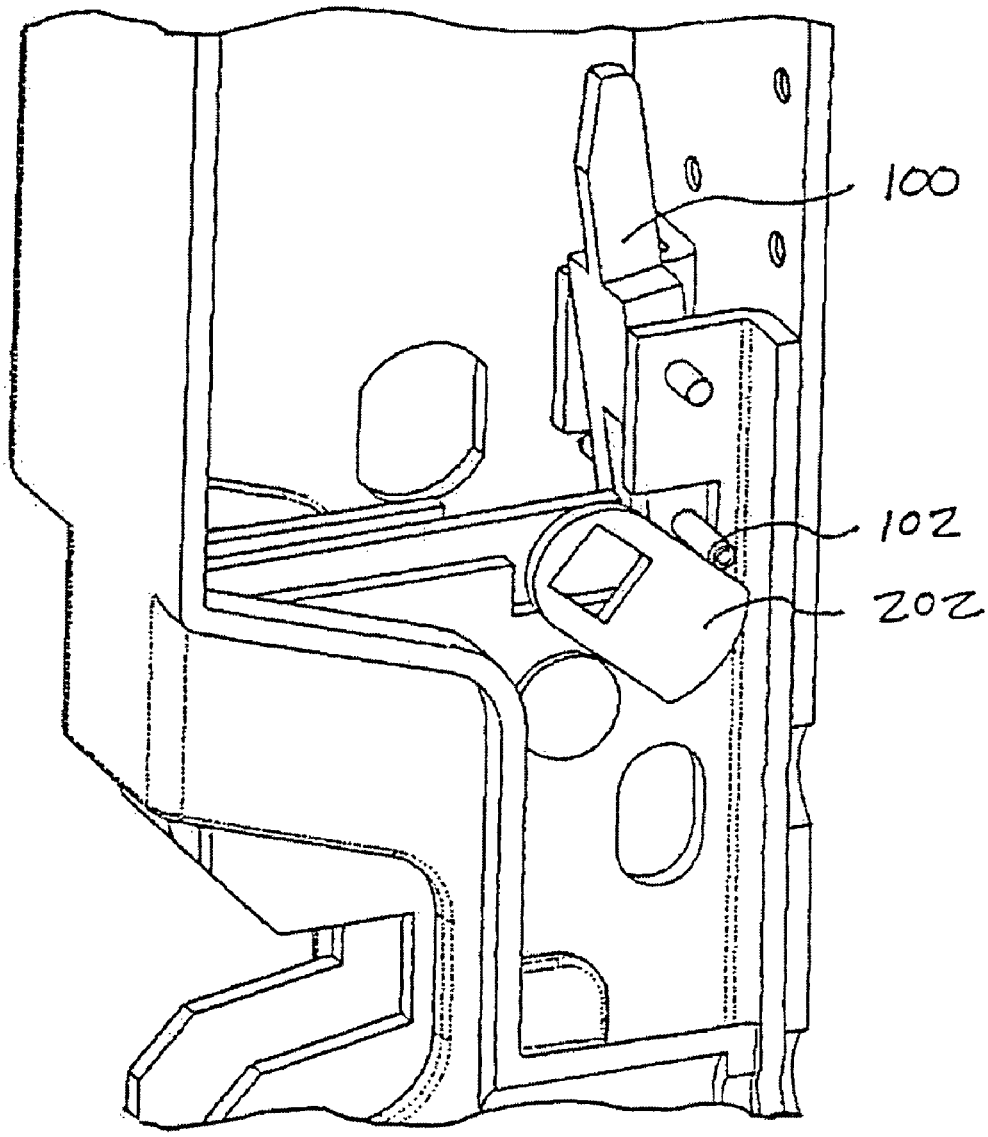
FIG. 10 is a view similar to FIG. 9 showing the manual override in an operational position releasing the transfer bar.

Referring to FIGS. 9 and 10, a manual override can be incorporated. A key operated cylinder lock 200 having an arm 202 is provided in the side of the chassis. Manual operation of the lock with a key will rotate the arm 202 into engagement with the blocking pin 102 moving it to a position freeing the transfer bar 100 as seen in FIG. 10.

Figure 12:
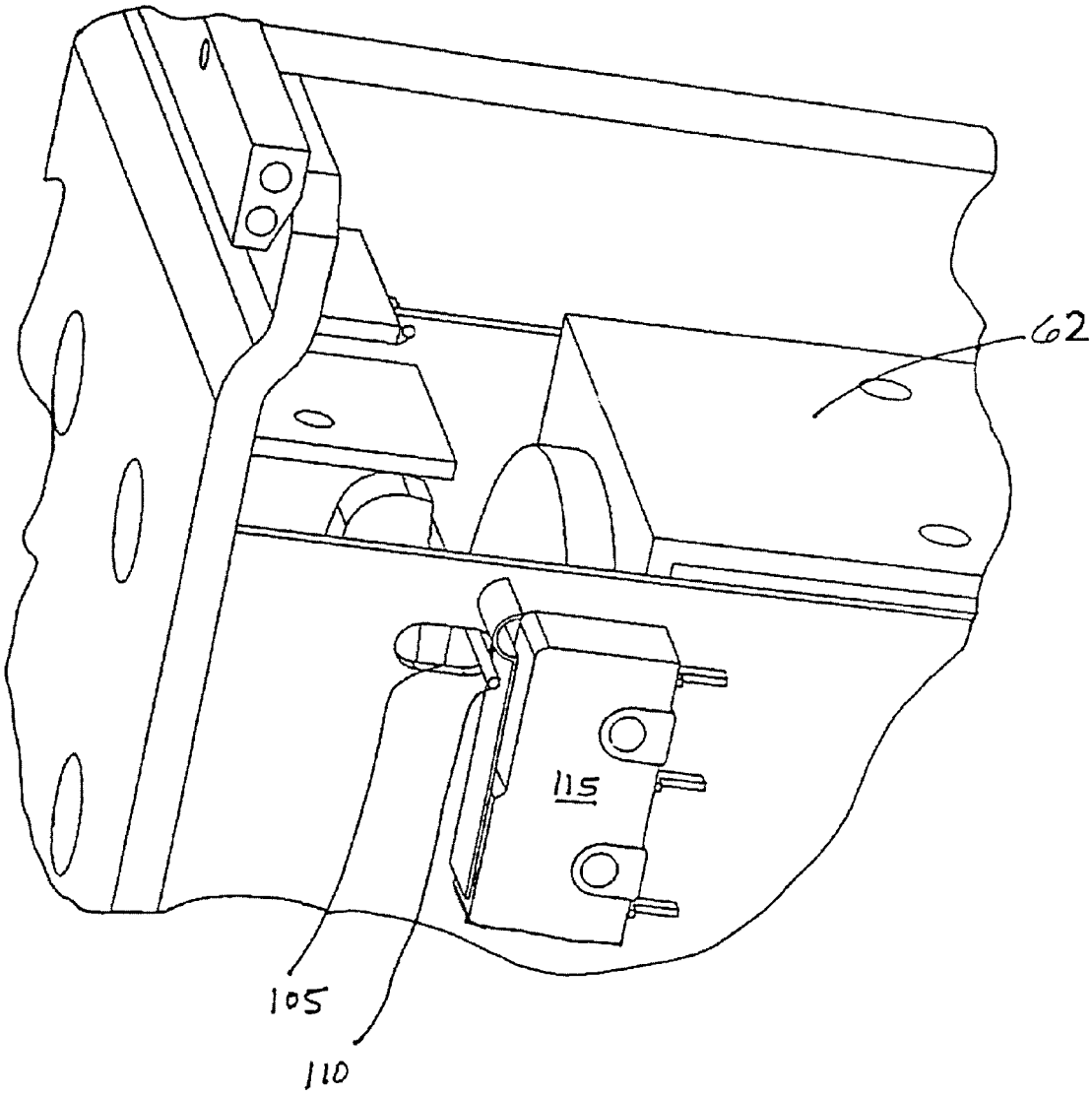
FIG. 12 illustrates the switch engaged by the transfer bar to provide a signal indicative of the condition of the lock.

Referring to FIG. 12, the lock may be provided with a sensor indicative of the condition of the lock. A pin 110 extends across the chassis adjacent the transfer bar 100 and is slidable in slots 105. The pin 110 is engageable with the end of the transfer bar 100 in the locked position. When the lock is opened, the transfer bar 100 moves to a position engaging pin 110 activating the switch 115 interrupting an electrical circuit which is remotely connected to provide a visual or audible indication of the condition of the lock. This signal can be processed to provide additional information such as time of occurrence of gate locking and unlocking.

Figure 8:
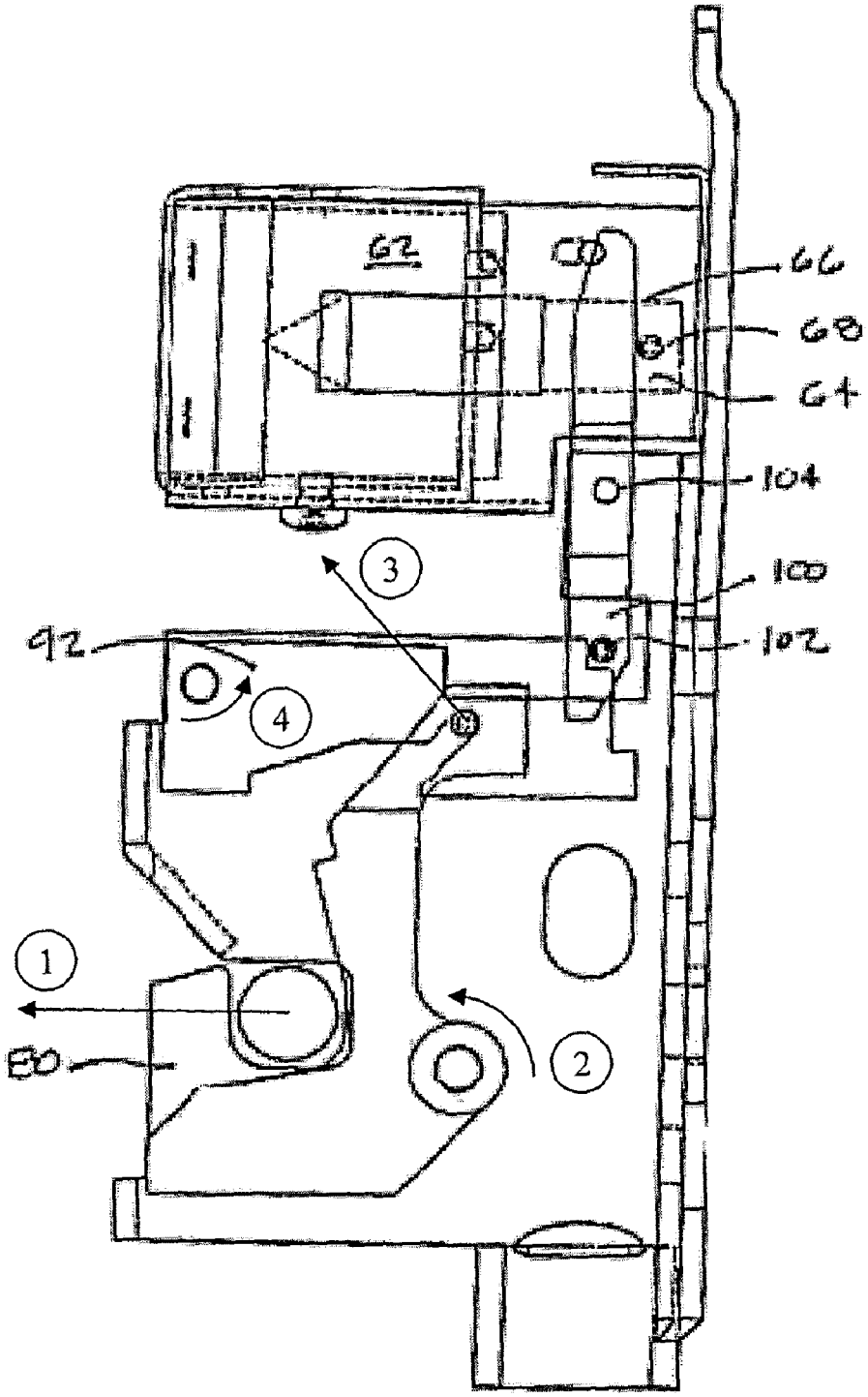
FIG. 8 is a side view of the latch setting forth the sequence that occurs upon opening.

Referring to FIG. 8, the relationship of the components allow the lock to open even under preload forces. The ability to operate under a preload is incorporated to provide operational capacity in the event the gate closure imposes a load on the latch due to conditions such as sliding gate activation prior to latch activation, pressure by human contact on the gate wind, gate damage or the like. With the lock of the present invention, proper release occurs under such conditions and a preload force of 100 pounds transmits only a force of 13 pounds (vector 3) which must be overcome by the trigger 92.

As seen in FIG. 8, the angled slot 120 in the trigger in which the cam follower pin 98 rides is a key feature of the device which allows it to operate under pre-load. The angle is selected so that the forces on the latch 80, when loaded in the opening direction are directed to force the trigger 100 to open. The rear face of the angled trigger slot 120 catches the cam follower pin 98 as it is rotated back upon closing. The angled slot catches the pin and the pin pulls the trigger down as an "auto-reset."

Thus it will be seen that the present invention provides an improved electro-mechanical lock for various applications such as security gates which allows proper operation of the device even if some misalignment of the components occurs.

The design of the components provide security and resistance to tampering and the lock allows unlatching with higher preload between the latching components and strike.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A strike assembly cooperating with a latch assembly, the strike assembly comprising:

(a) a strike base shield;

(b) a clevis member mounted to said strike base shield, and having a baseplate and spaced-apart arms extending away from said baseplate, each arm comprising a receiving hole;

(c) a striker sleeve mounted between said arms of said clevis member by mounting means received through each receiving hole;

(d) a cover plate affixed to said strike base shield, said cover plate having a housing section overlying said baseplate of said clevis member, said housing section being spaced from said strike base shield when said cover plate is affixed to said strike base shield; and (e) biasing means interposed between said housing section of said cover plate and said baseplate of said clevis member, said biasing means allowing said clevis member to swivel a range of motion to compensate for misalignment when said strike assembly is moved to cooperate with the latch assembly.

2. The strike assembly of claim 1 wherein said strike base shield is generally U-shaped having spaced-apart flanges and wherein said clevis member is generally U-shaped being positioned having its arms between the flanges of said strike base shield.

3. The strike assembly of claim 2 wherein said arms of said clevis member are positioned closely adjacent to said flanges of said strike base shield.

4. The strike assembly of claim 1 wherein said arms of said clevis member define apertures which receive pins and wherein said striker sleeve is cylindrical defining a bore which receives said pins.

5. A latch assembly for engagement with a strike, said latch assembly comprising:

(a) a chassis defining an opening configured for receiving the strike;

(b) an actuator having a plunger, said plunger moveable by said actuator between a first plunger position and a second plunger position;

(c) a latch pivotal in said chassis, said latch having a keeper movable between a first locked position and a second unlocked position wherein, when said keeper is in said first locked position, a keeper seat prevents the strike from being removed from said opening and when said keeper is in said second unlocked position, the strike may be removed from said opening;

(d) a trigger pivotally mounted in said chassis, said trigger having a cam surface engageable with a follower on said latch, wherein said trigger is moveable between a first keeper hold position and a second keeper release position; and (e) a transfer bar extending between said plunger and said trigger which in a first blocking position blocks pivotal movement of said trigger and in a second unblocking position permits movement of said trigger wherein, when said transfer bar is in said second unblocking position, said latch and said trigger are configured such that, when a first force generated by an external source is applied to said strike in a direction to remove said strike from said opening when said keeper is in said first locked position and said trigger is in said first keeper hold position, a second force applied to said trigger by said latch causes said trigger to move to said second keeper release position.

6. The strike assembly of claim 5 wherein said first force vector applied to the strike is greater than said second force applied to said trigger.

7. The latch assembly of claim 6 further including a tamper-resistant housing enclosing said actuator, said trigger, said latch and said transfer bar, wherein said tamper-resistant housing is secured to said chassis by shielded fasteners.

8. The latch assembly of claim 6 wherein said actuator has a distal end which is slotted having a pin extending across said slotted distal end, and wherein said transfer bar is pivotally mounted in said chassis having an upper end and a lower end, said upper end being received in said slotted distal end and retained therein.

9. The latch assembly of claim 6 wherein a lower end of said transfer bar includes a blocking pin, wherein said blocking pin is configured for engaging, said trigger.

10. The strike assembly of claim 6 wherein said first force is directed at an acute angle relative to said cam surface.

11. The latch assembly of claim 5 further including a sensor engageable by one of said transfer bar, said trigger or said latch to provide an indication of the condition of said latch assembly.

12. The latch assembly of claim 5 wherein said trigger, said actuator and said transfer bar are capable of being arranged in a fail safe or a fail secure mode, wherein in said fail secure mode, said transfer bar is in said locked position to block pivotal movement of said trigger when said actuator is in a de-energized state, and wherein in said fail safe mode, said transfer bar is in said unlocked position to permit said trigger to release said latch when said actuator is in said de-energized state.

13. A latch assembly having a locked and unlocked position for engagement with a strike, said latch assembly comprising:

(a) a chassis defining an opening configured for receiving the strike;

(b) an actuator having a plunger, said plunger movable by said actuator between a first position and a second position;

(c) a latch pivotal in said chassis, said latch having a keeper having a seat in a locked position which extends in a blocking position relative to said opening and in an unlocked position allowing the strike to enter or exit said seat wherein said latch has an end distal from said keeper having a slot extending in a direction that is transverse to a rotational axis of said latch;

(d) a trigger pivotally mounted in said chassis having a cam surface engageable with a follower on said latch, wherein said follower extends across said slot, and wherein said cam surface of said trigger is configured for being received in said slot; and (e) a transfer bar extending between said plunger and said trigger which in a first position blocks pivotal movement of said trigger and in a second position permits said trigger to release said latch to allow said latch to rotate to said unlocked position.

14. A lock assembly comprising a strike assembly and a latch assembly, (a) said strike assembly comprising:

(i) a strike base shield;

(ii) a clevis member mounted to said strike base shield, and having a generally U-shape with a baseplate and spaced-apart arms extending away from said baseplate, each arm comprising a receiving hole;

(iii) a striker sleeve mounted between said arms of said clevis member by mounting means received through each receiving hole;

(iv) a cover plate affixed to said strike base shield, said cover plate having a housing section overlying said baseplate of said clevis member, said housing section being spaced from said strike base shield when said cover plate is affixed to said strike base shield; and (v) biasing means interposed between said housing section of said cover plate and said baseplate of said clevis member, said biasing means allowing said clevis member to swivel a range of motion to compensate for misalignment when said strike assembly is moved to cooperate with a latch assembly; and (b) a said latch assembly comprising:

(i) a chassis defining an opening for receiving said strike assembly;

(ii) a solenoid having a plunger and actuable to move said plunger between a first and a second position;

(iii) a latch pivotal in said chassis defining a seat having a keeper, said latch having a locked position in which the said keeper extends in a blocking position relative to said opening and an unlocked position which allows said striker sleeve to enter or exit said seat;

(iv) a trigger pivotally mounted in said chassis having a cam surface engageable with said latch; and (v) a transfer bar extending between said plunger and said trigger which in the locked position blocks pivotal movement of said trigger and in the unlocked position permits said trigger to release said latch to allow said latch to rotate to the unlocked position.

15. The lock assembly of claim 14 wherein said latch assembly is housed in a tamper-resistant enclosure.

16. The lock assembly of claim 14, wherein said trigger and transfer bar are capable of being arranged in a fail safe mode or a fail secure mode wherein in said fail secure mode, said transfer bar is in said locked position to block pivotal movement of said trigger when said solenoid is in a de-energized state, and wherein in said fail safe mode, said transfer bar is in said unlocked position to permit said trigger to release said latch when said solenoid is in said de-energized state.

17. The lock assembly of claim 14 wherein said solenoid is locally operated by a keypad.

18. The lock assembly of claim 14 wherein said solenoid is remotely operable.

19. The lock assembly of claim 14 further including a manually-operated override.

20. The lock assembly of claim 14 wherein said chassis has an entry to guide said strike into said seat and wherein the width of said striker sleeve is greater than the width of said chassis to accommodate horizontal misalignment of said striker sleeve and said latch.

21. A strike assembly cooperating with a latch assembly, the strike assembly comprising:

(a) a strike base shield;

(b) a cover plate affixed to said strike base shield, said cover plate having a housing section, said housing section being spaced from said strike base shield when said cover plate is affixed to said strike base shield, said strike base shield and said housing section defining a recess;

(c) a clevis member including a baseplate and a striker sleeve, said baseplate being moveable positioned within said recess to couple said clevis member with said strike base shield; and (d) a spring interposed between said cover plate and said clevis member, said spring allowing said clevis member to move in a range of motion to compensate for misalignment when said strike assembly is moved to cooperate with the latch assembly.

* * * * *